US010228713B1

(12) United States Patent
Hanschke et al.

(10) Patent No.: US 10,228,713 B1
(45) Date of Patent: Mar. 12, 2019

(54) LARGE RANGE CURRENT MIRROR

(71) Applicant: TEXAS INSTRUMENTS INCORPORATED, Dallas, TX (US)

(72) Inventors: Michael Ryan Hanschke, Dallas, TX (US); Salvatore Giombanco, Cassaro (IT); Timothy Bryan Merkin, Princeton, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/850,072

(22) Filed: Dec. 21, 2017

(51) Int. Cl.
*G05F 3/26* (2006.01)

(52) U.S. Cl.
CPC ..... *G05F 3/262* (2013.01); *G05F 3/265* (2013.01)

(58) Field of Classification Search
CPC ..... G05F 3/262; G05F 3/265
See application file for complete search history.

(56) References Cited

U.S. PATENT DOCUMENTS

| | | | | |
|---|---|---|---|---|
| 7,388,787 | B2 * | 6/2008 | Portmann | G05F 3/262 365/185.18 |
| 2009/0219103 | A1 * | 9/2009 | Kriebernegg | H03B 5/36 331/116 R |
| 2015/0261246 | A1 * | 9/2015 | Doorenbos | G05F 3/02 323/268 |
| 2016/0091916 | A1 * | 3/2016 | Chang | G05F 3/262 323/268 |
| 2016/0187207 | A1 * | 6/2016 | Li | G05F 3/02 374/1 |
| 2018/0059703 | A1 * | 3/2018 | Doorenbos | G05F 3/30 |

* cited by examiner

*Primary Examiner* — Emily P Pham
(74) *Attorney, Agent, or Firm* — Tuenlap Chan; Charles A. Brill; Frank D. Cimino

(57) ABSTRACT

A current mirror includes a first pair of transistors, wherein gates of the first pair of transistors are connected together, and a second pair of transistors coupled to the first pair of transistors. Gates of the second pair of transistors are connected together. A first resistive device is coupled across a drain and a source of one of the transistors of the second pair of transistors. A second resistive device is coupled across a drain and a source of the other transistor of the second pair of transistors. The first pair of transistors are configured to operate in weak inversion at an input current to the current mirror within a first current range and the second pair of transistors are configured to operate in strong inversion at an input current within a second current range.

21 Claims, 2 Drawing Sheets

LARGE RANGE CURRENT MIRROR

BACKGROUND

A current mirror is a circuit that produces an output current at approximately the same current level as the input current. Current mirrors are used in a variety of applications and are designed for a relatively narrow expected range of input currents. As such, a current mirror designed to produce a copy of a 1 microampere (microamp) input current may not work satisfactorily to produce an accurate copy of a 1 milliamp input current.

SUMMARY

Examples of current mirrors described herein permit accurate reproduction of an input current as an output current over a relatively wide range of input currents. In one example, a current mirror includes first, second, third and fourth transistors and first and second resistors. The first transistor is configured to receive an input current. The second transistor is coupled to the first transistor. The first resistor is coupled across the second transistor. A gate of the first transistor is coupled to a gate of the third transistor. The third transistor is configured to flow an output current of the current mirror through the third transistor. The fourth transistor is coupled to the third transistor. The second resistor is coupled across the fourth transistor.

In another example, a current mirror includes first, second, third and fourth transistors and first and second resistors. The first transistor is configured to receive an input current. A drain of the second transistor is connected to a source of the first transistor. The first resistor is connected to the drain of the second transistor and to a source of the second transistor. A gate of the first transistor is connected to a gate of the third transistor. The third transistor is configured to flow an output current of the current mirror through the third transistor. A drain of the fourth transistor is connected to a source of the third transistor. The second resistor is connected to the drain of the fourth transistor and a source of the fourth transistor. Further, the first and third transistors are configured to operate in weak inversion at an input current within a first current range and the second and fourth transistors are configured to operate in strong inversion at an input current within a second current range.

In yet another example, a current mirror includes a first pair of transistors, wherein gates of the first pair of transistors are connected together, and a second pair of transistors coupled to the first pair of transistors. Gates of the second pair of transistors are connected together. A first resistor is coupled across a drain and a source of one of the transistors of the second pair of transistors. A second resistor is coupled across a drain and a source of the other transistor of the second pair of transistors. The first pair of transistors are configured to operate in weak inversion at an input current to the current mirror within a first current range and the second pair of transistors are configured to operate in strong inversion at an input current within a second current range.

BRIEF DESCRIPTION OF THE DRAWINGS

For a detailed description of various examples, reference will now be made to the accompanying drawings in which.

DETAILED DESCRIPTION

Figure 1:
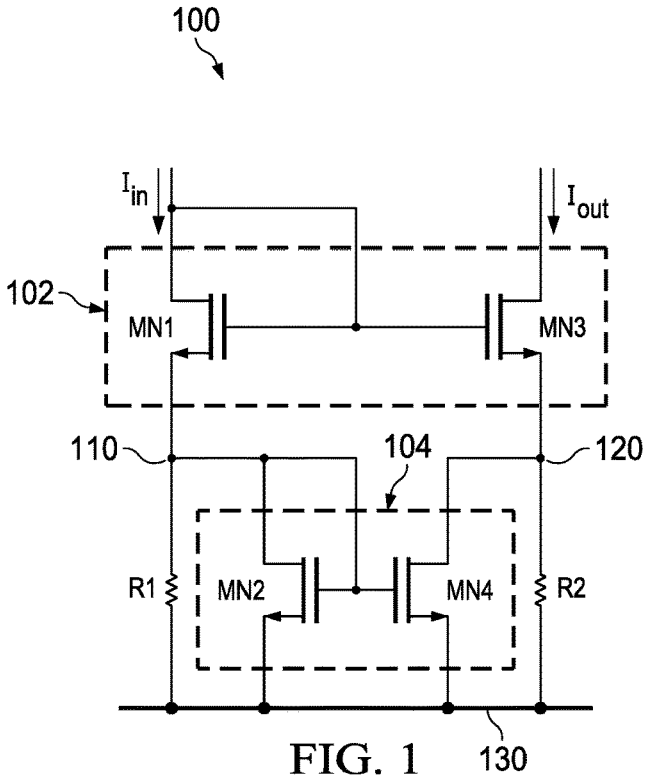
FIG. 1 illustrates a current mirror in accordance with an example comprising n-type metal oxide semiconductor field effect transistors.

FIG. 1 shows an example of a current mirror 100 in accordance with an embodiment. The current mirror 100 in this example includes a first pair 102 of transistors MN1 and MN2, a second pair 104 of transistors MN2 and MN4, and resistors R1 and R2. The transistors MN1-MN4 in this embodiment comprise n-type metal oxide semiconductor field effect transistors. Each of the transistors MN1-MN4 include a control input and a pair of current terminals. As field effect transistors, the control input includes a gate terminal and the current terminals comprise source and drain terminals. In other examples, the current mirror can be implemented with bipolar junction transistors (BJTs) and, in those examples, the control input comprises a base terminal and the current terminals comprise emitter and collector terminals.

MN1 is configured to receive input current Iin. A current terminal of MN2 is coupled to a current terminal of MN1. In this example, the drain of MN2 is connected to the source of MN1 as shown. The gate and drain of MN1 are connected together as well. Resistor R1 is coupled across MN2 between the drain and source of MN2. The gate and drain of MN2 are connected together. Resistors R1 and R2 and the sources of MN2 and MN4 are connected to a common potential (e.g., ground) 130.

The right-hand side of the current mirror 100 is similarly configured. The output current Iout is caused to flow through MN3. A current terminal (e.g., the drain) of MN4 is coupled to a current terminal (e.g., the source) of MN3. MN1 can be connected to any circuit that generates a positive potential relative to MN1's drain and ground which will cause a conduction path for current to be mirrored on the right-hand side of the current mirror 100 (through MN3). Examples of circuits connected to the drain of MN1 include a resistor connecting a supply voltage to the drain of MN1, a current source connected from a supply voltage to the drain of MN1, a positive ground referenced voltage source connected to the drain of MN1, etc. Resistor R2 is coupled across MN4 between the drain and source of MN4. The gates of MN1 and MN3 are connected together, and the gates of MN2 and MN4 are connected together. Resistors or other types of resistive devices (as noted below) can be used as R1 and R2.

Other components may be included as well, and may be disposed between any of the components shown in FIG. 1. For example, MN1 is shown connected to MN2, but in some examples, another electrical component may be included in the circuit between MN1 and MN2. Thus, while the circuit of FIG. 1 includes various components directly connected together as shown, in other embodiments, such components may be indirectly coupled together by way of one or more intervening components.

The disclosed embodiments are directed to a current mirror 100 that can accurately operate for a relatively wide range of input current Iin. That is, for a particular range of Iin, the output current Iout will approximately match Iin. At lower levels of Iin, MN1 and MN3 are configured to operate in weak inversion. Weak inversion also may be referred to as the subthreshold region or cutoff region. Weak inversion refers to the operating region of a metal oxide semiconductor field effect transistor (MOSFET) when the gate-to-source bias voltage is less than the MOSFET's threshold voltage and which exhibits a drain to source current (Id) characteristic that is approximated by $$Id = \mu * Cox * \left(\frac{W}{L}\right) * \left(\frac{kT}{q}\right)^2 * (n-1) * e^{\frac{q(Vgs-Vt)}{n*kT}}$$

where μ is the carrier mobility in the MOSFET channel, Cox is the gate oxide capacitance, W is the width of the MOSFET channel, L is the length of the MOSFET channel, kT is the product of the Boltzman's constant and the absolute junction temperature, q is the elementary electron charge, n is subthreshold slope factor for the process technology used for the current mirror 100, Vgs is the gate-to-source voltage, and Vt is the threshold voltage. At higher levels of Iin, MN2 and MN4 are configured to operate in strong inversion. Strong inversion also may be referred to as saturation. Strong inversion refers to the operating region of a MOSFET when the gate-to-source bias voltage is greater than the MOSFET's threshold voltage, and which exhibits a drain to source current characteristic that is approximated by $$Id = \frac{\mu * Cox}{2} * \left(\frac{W}{L}\right) * (Vgs - Vt)^2$$

An example of the lower current level is provided below. Structurally, transistors operating in weak inversion will have a higher W/L ratio (ratio of channel width to channel length) than transistors operating in strong inversion for the same current magnitude. In one example, the W/L ratio of MN1 and MN3 is approximately 4 while ratio of W/L ratio of MN2 and MN4 is approximately 250.

At a lower current range with MN1 and MN3 operating in weak inversion, all of the input current Iin flows through MN1 and all of the output current Iout flows through MN3. Most of the input current then flows through resistor R1, with the balance of Iin flowing through MN2. Similarly, most of the output current flows through resistor R2, with the balance of Iout flowing through MN4. More of the input current flows through R1 than through MN2 because the voltage across R1 is relatively small and the voltage across R1 is both the drain-to-source voltage (Vds) and the gate-to-source voltage (Vgs) of MN2. With Vgs being relatively low compared to the threshold voltage (Vt) for MN2, relatively little current flows through MN2. The same is true for the current flow through R2 and MN4, that is, most of Iout flows through R2 with the balance flowing through MN4. In one embodiment, more than 50% of Iin flows through R1 with the rest through MN2, and similarly, more than 50% of Iout flows through R2 with the rest through MN4. In other embodiments, more than 80% of Iin flows through R1 with the rest through MN2, and more than 80% of Iout flows through R2 with the rest through MN4. In yet other embodiments, more than 90% of Iin flows through R1 with the rest through MN2, and more than 90% of Iout flows through R2 with the rest through MN4.

Because most of the input current Iin flows through resistor R1 and most of the output current flows through resistor R2 at the lower current range, the resistance value of resistors R1 and R2 should be configured to match within a desired tolerance level. Further, for adequate accuracy of the current mirror 100 in the lower current range, MN1 and MN3 should match as well (e.g., in terms of the size and threshold voltage).

At a higher current range (an example of which is provided below), MN2 and MN4 operate in strong inversion. Matching of Iout to Iin in the higher current range is a function of how closely R1 to R2 match and how closely M2 to M4 match in strong inversion (e.g., a match of their threshold voltages, gate widths and gate lengths). The higher current range comprises a range of current levels that is higher than the current levels of the lower current range. That is, the higher current range is higher than, and does not overlap with, the lower current range. At the higher current range, all of the input current still flows through MN1, and some of the input current flows through MN2 and the rest flows through R1. The voltage on node 110, which represents the voltage across R1 and the Vds of MN2, is clamped due to the MOSFET-connected diode configuration, where Vds of MN2 is equal to Vgs of MN2. The term "clamped" in this example means that the voltage across R1 does not vary linearly with the drain current through MN2 and/or is maintained within a stable range. The Vds of MN2 can be approximated as $$\sqrt{\frac{2 * Id}{\mu * Cox * W / L}} + Vth$$

which shows that the voltage is proportional to the square root of Id, and requires large increases in current for small increases in voltage. The voltage across R1 being clamped provides a headroom advantage by avoiding the need for an excessively large output voltage. This clamping structure can help prevent excessive voltages on the sources of MN1 and MN3 as well as limit the maximum current flow through R1 and R2 by shunting current through MN2 and MN4. This can serve as additional stability and protection against device overstress conditions. The voltage across R1 remains relatively fixed even as the input current increases even further. With the voltage across R1 being clamped, the current through R1 also is fixed. Thus, as Iin varies within the upper current range, the current through R1 is fixed and the balance of Iin flows through MN2, and thus the current through MN2 varies with variations in Iin.

The operation of the output current side of the current mirror functions similarly in the higher current range of Iin. That is, all of the output current flows through MN3, and some of input current flows through MN4 and the rest flows through R2. The voltage on node 120, which represents the voltage across R2 and the Vds of MN4 is clamped for the same reason as for the voltage on node 110. The voltage across R2 remains relatively fixed even as the input current increases even further. With the voltage across R2 being clamped, the current through R2 also is fixed. Thus, as Iout varies within the upper current range of Iin, the current through R2 remains fixed and the balance of Iout flows through MN4, and thus the current through MN4 varies with variations in Iin (and Iout).

At input current levels between the lower current range and the higher current range (that is, at an intermediate current range), MN2 and MN4 operate in weak inversion or at the edge of strong inversion. Some of the input current flows through R1 and the rest through MN2, and similarly, some of the output current flows through R2 and the rest through MN4. In the intermediate current range, in some embodiments, less than 90% of the input current flows through R1 and less than 90% of the input current flows through MN2. Similarly, less than 90% of the output current flows through R2 and less than 90% of the output current flows through MN4. In other words, between 10% and 90% of the input current flows through each of R1 and MN2 for Iin in the intermediate current range, and similarly, 10% and 90% of the output current flows through each of R2 and MN4 in the intermediate current range. The 10% to 90% range for the current flow between R1 and MN2 and between R2 and MN4 can vary in other embodiments, for example, 20% to 80%, 30% to 70%, etc. The current through the transistors is governed by the equations above and thus, in part, based on the W/L ratio for each transistor. Thus, design variations in the W/L ratio dictates, in part, the lower, intermediate, and higher current ranges.

The lower, intermediate and higher current ranges may vary from application to application. For example, the lower current range in one application may comprise input currents between approximately 300 nanoamperes and 1.2 microamperes, while the intermediate current range comprises currents between 1.2 microamperes and 2 microamperes, and the higher current range comprises currents between 2 microamperes and 20 microamperes. In some embodiments, the current mirror 100 can mirror an input current within a wide range of 100×.

Figure 2:
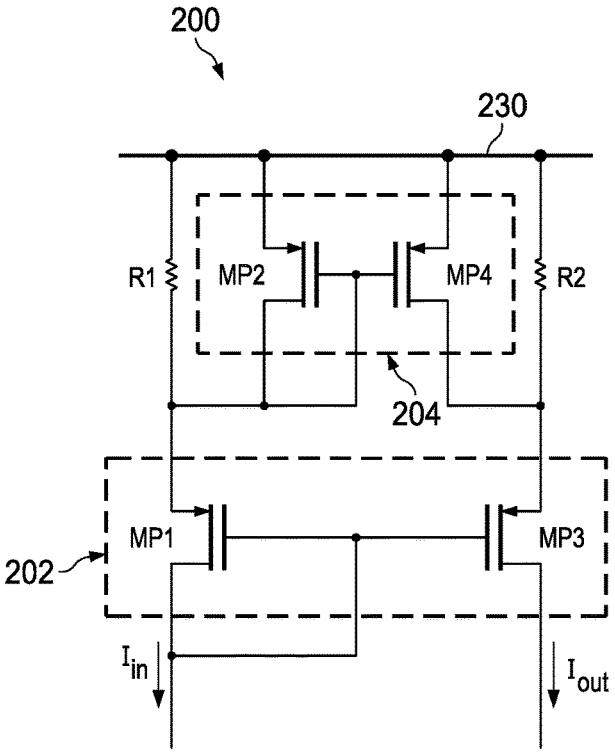
FIG. 2 illustrates a current mirror in accordance with another example comprising p-type metal oxide semiconductor field effect transistors.

FIG. 2 shows an example of a current mirror 200, similar to that of current mirror 100, but with the transistors implemented as p-type metal oxide semiconductor field effect transistors. Thus, the transistors are designated as a first pair 202 of transistors MP1 and MP3 and a second pair 204 of transistors MP3 and MP4. The input current Iin flows through MP1. MP2 is coupled to the MP1 by way of current terminals of MP2 and MP1. In this example, the drain of MP2 is connected to the source of MP1 shown. The gate and drain of MP1 are connected together. Resistor R1 is coupled across MP2 between the drain and source of MP2. The gate and drain of MP2 are connected together.

The output current side of the current mirror 100 is similarly configured. The output current Iout is caused to flow through MP3. MP4 is coupled to the MP3 by way of current terminals of MP4 and MP3. The drain of MP4 is connected to the source of MP3 in this example. Resistor R2 is coupled across MP4 between the drain and source of MP4. The gates of MP1 and MP3 are connected together, and the gates of MP2 and MP4 are connected together. Resistors R1 and R2 and the sources of MP2 and MP4 are connected to a common potential (e.g., ground) 230. The operation of the current mirror 200 is similar to that described above with respect to current mirror 100.

Figure 3:
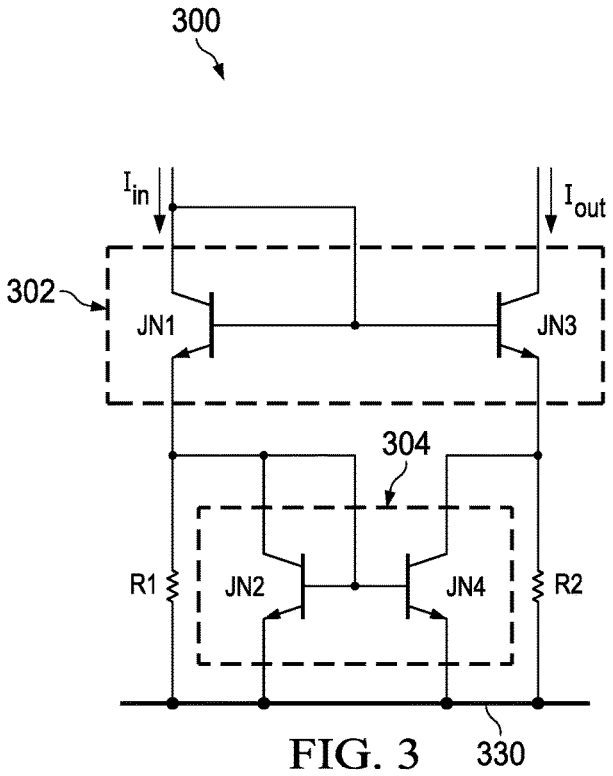
FIG. 3 illustrates a current mirror in accordance with an example comprising n-type bipolar junction transistors.

FIGS. 1 and 2 illustrate current mirror implementations with MOSFET devices. FIG. 3 includes an implementation similar to that of FIG. 1 but with NPN BJT devices. The current mirror 300 of FIG. 3 includes a pair 302 of transistors JN1 and JN2, a second pair 304 of transistors JN2 and JN4, and resistors R1 and R2. JN1 is configured to receive input current Iin. A current terminal of JN2 (the collector of JN2 in this example) is coupled to a current terminal of JN1 (the emitter of JN1 in this example). The base and emitter of JN1 are connected together as well. Resistor R1 is coupled across JN2 between the emitter and collector of MN2. The base and collector of JN2 are connected together. Resistors R1 and R2 and the emitters of JN2 and JN4 are connected to a common potential (e.g., ground) 330.

The right-hand side of the current mirror 300 is similarly configured. The output current Iout is caused to flow through JN3, using circuits such as that described above. A current terminal (e.g., the collector) of JN4 is coupled to a current terminal (e.g., the emitter) of JN3. Resistor R2 is coupled across JN4 between the collector and emitter of JN4. The bases of JN1 and JN3 are connected together, and the bases of JN2 and JN4 are connected together. The operation of the current mirror 300 is similar to that described above regarding current mirror 100.

Figure 4:
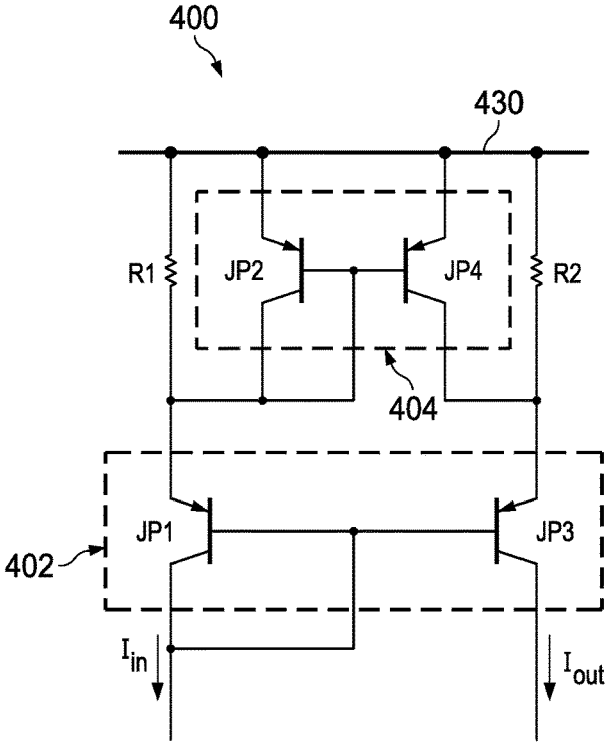
FIG. 4 illustrates a current mirror in accordance with another embodiment comprising p-type bipolar junction transistors.

FIG. 4 includes an implementation similar to that of FIG. 2 but with PNP BJT devices. The current mirror 400 of FIG. 3 includes a pair 402 of transistors JP1 and JP2, a second pair 404 of transistors JP2 and JP4, and resistors R1 and R2. JP1 is configured to receive input current Iin. A current terminal of JP2 (the collector of JP2 in this example) is coupled to a current terminal of JP1 (the emitter of JP1 in this example). The base and emitter of JP1 are connected together as well. Resistor R1 is coupled across JP2 between the emitter and collector of MP2. The base and collector of JP2 are connected together. Resistors R1 and R2 and the emitters of JP2 and JP4 are connected to a common potential (e.g., ground) 430.

The right-hand side of the current mirror 400 is similarly configured. The output current Iout is caused to flow through JP3, using circuits such as that described above. A current terminal (e.g., the collector) of JP4 is coupled to a current terminal (e.g., the emitter) of JP3. Resistor R2 is coupled across JP4 between the collector and emitter of JP4. The bases of JP1 and JP3 are connected together, and the bases of JP2 and JP4 are connected together. The operation of the current mirror 400 is similar to that described above regarding current mirror 100.

Figure 5:
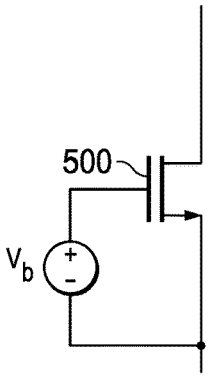
FIG. 5 shows an example of a resistive device usable in the examples of FIGS. 1-4.

The above examples include resistors R1 and R2. In other examples, other types of resistive devices can be used. FIG. 5, for example, illustrates an example of a MOSFET 500 that is biased (via bias voltage Vb) in the triode region. Vb is configured to be that is greater than the drain-to-source voltage plus the threshold voltage of the transistor to which MOSFET 500 is coupled across (e.g., MN2 for MOSFET 500 coupled to MN2, MN4 for MOSFET 500 coupled to MN4, and so on).

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct wired or wireless connection. Thus, if a first device couples to a second device, that connection may be through a direct connection or through an indirect connection via other devices and connections.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A current mirror, comprising:

a first transistor having a first diode configuration to receive an input current;

a second transistor having a second diode configuration including a current terminal coupled to a current terminal of the first transistor;

a first resistive device coupled across the second transistor;

a third transistor, wherein a gate of the first transistor is coupled to a gate of the third transistor, and wherein the third transistor is configured to flow an output current of the current mirror through the third transistor;

a fourth transistor including a current terminal coupled to a current terminal of the third transistor; and a second resistive device coupled across the fourth transistor.

2. The current mirror of claim 1, wherein each of the first, second, third and fourth transistors comprises n-type metal oxide semiconductor field effect transistors.

3. The current mirror of claim 1, wherein each of the first, second, third and fourth transistors comprises p-type metal oxide semiconductor field effect transistors.

4. The current mirror of claim 1, wherein each of the first, second, third and fourth transistors comprises n-type bipolar junction transistors.

5. The current mirror of claim 1, wherein each of the first, second, third and fourth transistors comprises p-type bipolar junction transistors.

6. The current mirror of claim 1, wherein a source of the first transistor is connected to a drain of the second transistor, and wherein a source of the third transistor is connected to a drain of the fourth transistor.

7. The current mirror of claim 1, wherein:

the first and third transistors are configured to operate in weak inversion at an input current within a first current range;

the second and fourth transistors are configured to operate in strong inversion at an input current within a second current range; and the first current range comprises current levels, the second current range comprises current levels, and all of the current levels in the second current range are larger than all of the current levels included in the first current range.

8. The current mirror of claim 7, wherein for the first current range:

the input current flows through the first transistor;

more than 90% of the input current flows through the first resistive device with a balance of the input current flowing through the second transistor;

the output current flows through the third transistor;

more than 90% of the output current flows through the second resistive device with a balance of the output current flowing through the fourth transistor.

9. The current mirror of claim 7, wherein for input currents having current levels greater than the first current range and less than the second current range:

the input current flows through the first transistor;

less than 90% of the input current flows through the first resistive device and less than 90% of the input current flows through the second transistor;

the output current flows through the third transistor;

less than 90% of the output current flows through the second resistive device and less than 90% of the input current flows through the fourth transistor.

10. The current mirror of claim 7, wherein for the second current range:

the input current flows through the first transistor;

more than 90% of the input current flows through the second transistor with a balance of the input current flowing the first resistive device;

the output current flows through the third transistor;

more than 90% of the output current flows through the second resistive device with a balance of the input current flowing the fourth transistor.

11. The current mirror of claim 7, wherein for the second current range:

the first transistor is configured to receive input current;

a voltage across the first resistive device is configured to be clamped causing a fixed amount of the input current to flow through the first resistive device with the second transistor configured to receiver a balance of the input current;

the third transistor is configured to receive the output current; and a voltage across the second resistive device is configured to be clamped causing a fixed amount of the input current to flow through the second resistive device with the fourth transistor configured to receive a balance of the output current.

12. A current mirror, comprising:

a first transistor having a first diode configuration to receive an input current;

a second transistor having a second diode configuration, wherein a drain of the second transistor is connected to a source of the first transistor;

a first resistive device connected to the drain of the second transistor and a source of the second transistor;

a third transistor, wherein a gate of the first transistor is connected to a gate of the third transistor, and wherein the third transistor is configured to flow an output current of the current mirror through the third transistor;

a fourth transistor, wherein a drain of the fourth transistor is connected to a source of the third transistor; and a second resistive device connected to the drain of the fourth transistor and a source of the fourth transistor;

wherein each of the first and third transistors have a channel width and a channel length and a ratio of channel width to channel length and each of the second and fourth transistors have a channel width and a channel length, and wherein a ratio of the channel width to the channel length of each of the first and third transistors is greater than the ratio of the channel width to the channel length of each of the second and fourth transistors.

13. The current mirror of claim 12, wherein each of the first, second, third and fourth transistors comprises n-type metal oxide semiconductor field effect transistors.

14. The current mirror of claim 12, wherein each of the first, second, third and fourth transistors comprises p-type metal oxide semiconductor field effect transistors.

15. The current mirror of claim 12, wherein for a first current range of the input current:

the input current flows through the first transistor;

more than 80% of the input current flows through the first resistive device with a balance of the input current flowing through the second transistor;

the output current flows through the third transistor;

more than 80% of the output current flows through the second resistive device with a balance of the output current flowing through the fourth transistor.

16. The current mirror of claim 15, wherein for input currents at current levels greater than the first current range and less than a second current range:

the input current flows through the first transistor;

less than 80% of the input current flows through the first resistive device and less than 80% of the input current flows through the second transistor;

the output current flows through the third transistor;

less than 80% of the output current flows through the second resistive device and less than 80% of the input current flows through the fourth transistor.

17. The current mirror of claim 16, wherein for the second current range:

the input current flows through the first transistor;

more than 80% of the input current flows through the second transistor with a balance of the input current flowing the first resistive device;

the output current flows through the third transistor;

more than 80% of the output current flows through the second resistive device with a balance of the input current flowing the fourth transistor.

18. The current mirror of claim 16, wherein for the second current range:

the input current flows through the first transistor;

a voltage across the first resistive device is clamped thereby causing a fixed amount of the input current to flow through the first resistive device with a balance of the input current flowing through the second transistor;

the output current flows through the third transistor;

a voltage across the second resistive device is clamped thereby causing a fixed amount of the input current to flow through the second resistive device with a balance of the output current flowing through the fourth transistor.

19. A current mirror, comprising:

a first pair of transistors, wherein gates of the first pair of transistors are connected together, and at least one of the first pair of transistors is diode-connected;

a second pair of transistors including current terminals coupled to current terminals of the first pair of transistors, wherein gates of the second pair of transistors are connected together, and at least one of the second pair of transistors is diode-connected;

a first resistive device coupled across a drain and a source of a first one of the second pair of transistors; and a second resistive device coupled across a drain and a source of a second one of the second pair of transistors;

wherein the first pair of transistors are configured to operate in weak inversion at an input current to the current mirror within a first current range and the second pair of transistors are configured to operate in strong inversion at an input current within a second current range.

20. The current mirror of claim 19, wherein the first current range does not overlap with the second current level range.

21. The current mirror of claim 19, wherein:

a first one of the first pair of transistors is configured to receive the input current, and a first portion of the input current is configured to flow through the first resistive device and a second portion of the input current is configured to flow through a first one of the second pair of transistors; and a second one of the first pair of transistors is configured to receive output current, and a first portion of the output current is configured to flow through the second resistive device and a second portion of the output current is configured to flow through a second one of the second pair of transistors.

* * * * *